US005678541A

United States Patent [19]

Garraffa

[11] Patent Number: 5,678,541

[45] Date of Patent: Oct. 21, 1997

[54] BREATHING REGULATOR APPARATUS HAVING AUTOMATIC FLOW CONTROL

[76] Inventor: Dean R. Garraffa, 20041 Treasure Cir., Huntington Beach, Calif. 92646

[21] Appl. No.: 616,223

[22] Filed: Mar. 15, 1996

[51] Int. Cl.[6] ..... A62B 7/04

[52] U.S. Cl. ..... 128/205.24; 128/204.26

[58] Field of Search ..... 128/204.26, 205.24, 128/201.27, 201.28, 200.29, 205.22, 207.12, 204.29; 137/315, 908

[56] References Cited

U.S. PATENT DOCUMENTS

| | | | |
|---|---|---|---|
| 3,308,817 | 3/1967 | Seeler | 128/203.25 |
| 3,526,241 | 9/1970 | Veit | 128/204.29 |
| 4,147,176 | 4/1979 | Christianson | 128/204.26 |
| 4,219,017 | 8/1980 | Shamlian | 128/204.26 |
| 4,266,538 | 5/1981 | Ruchti | 128/204.26 |
| 4,683,881 | 8/1987 | Hansen et al. | 128/204.26 |
| 4,711,263 | 12/1987 | Ottestad | 128/204.26 |
| 4,796,618 | 1/1989 | Garraffa | 128/204.26 |
| 5,097,860 | 3/1992 | Ferguson et al. | 128/204.29 |
| 5,251,618 | 10/1993 | Christianson | 128/205.24 |
| 5,259,375 | 11/1993 | Schuler | 128/205.24 |
| 5,368,020 | 11/1994 | Beax | 128/204.29 |
| 5,549,107 | 8/1996 | Garraffa et al. | 128/204.26 |

*Primary Examiner*—V. Miller
*Assistant Examiner*—William J. Deane, Jr.
*Attorney, Agent, or Firm*—Leonard Tachner

[57] ABSTRACT

A second stage breathing regulator especially suited for use in scuba diving comprises an automatically adjustable air flow deflector or vane to redirect a portion of inlet high velocity air of a venturi-initiated vacuum assist-type regulator configuration. At greater depths the flow vane increasingly interrupts and redirects a selected portion of the air stream to increase the venturi effect. As a result, the diver's inhalation effort requirements can be relatively constant throughout the breathing cycle at any depth or can be tailored to a desired non-constant profile as a function of depth. A piston responsive to ambient water pressure by extension proportional to depth, places the flow vane to increasingly redirect the air flow at greater depths thereby increasing the venturi effect. The diver is thus freed of having to make manual adjustments to the second stage under water.

10 Claims, 3 Drawing Sheets

BREATHING REGULATOR APPARATUS HAVING AUTOMATIC FLOW CONTROL

BACKGROUND OF THE INVENTION

1. Field of the Invention

The present invention relates generally to pressure regulation and self-contained breathing systems such as those used in scuba diving equipment and more specifically, to a new improved means for automatically altering the breathing characteristics of a demand-type regulator by automatic adjustment of the venturi action in the regulator in accordance with depth during diving.

2. Prior Art

Pressure regulators such as those employed in underwater breathing apparatus, utilize the pressure differential on opposite sides of a flexible-diaphragm to operate an air valve which supplies air to a breathing chamber from which the diver breathes. Typically, such a flexible diaphragm is mounted to cover an opening in the wall of the breathing chamber whereby expansion of the diaphragm actuates the air valve. More specifically, when the diver inhales while the air inlet valve is closed, the pressure in the breathing chamber is reduced causing the diaphragm to bow inwards inside the breathing chamber and thereby allowing an air inlet valve to open. When the diver exhales, pressure in the chamber increases causing the diaphragm to move out to its original condition thereby closing the air inlet valve.

Recent prior art includes disclosure of various pressure regulator structures which provide a reduction in the effort required by the diver to breathe from such regulators. More specifically, regulators have been designed so that a portion of the inlet air travels into the breathing mouthpiece area in the form of a stream of air which produces a venturi effect. This venturi effect further reduces the pressures in the breathing chamber so that in effect the diver is not necessarily doing all the work required to sufficiently reduce the breathing chamber pressure to pull in and retain the diaphragm and cracking effort force setting whereby to open the air inlet valve. Thus, the venturi effect makes its easier for the diver to inhale air from the regulator. Breathing regulators which employ such venturi-type action to assist in responding to the breathing demand of the diver are highly advantageous. Unfortunately, they are not always optimally configured for the breathing requirements for each diver or for particular diving depths where ambient pressure increases as a function of depth thereby changing the parameters for the diver's degree of breathing difficulty and breathing requirements.

In most scuba diving situations, the requirement for the second stage regulator can change. On the surface, the regulator must be stable. The second stage should not accidentally flow air without stopping on its own. Unfortunately, when a scuba regulator is tuned for stable surface operation (no venturi), the performance under deeper diving conditions can suffer. And if the regulator second stage is adjusted for deep diving, the surface performance can be too sensitive causing uncontrolled free flow of air forcing the scuba diver to manually stop the flow of air by blocking the mouthpiece exit with his finger or glove.

In response to this disadvantage of an otherwise advantageous concept, prior art patents have addressed various ways of altering venturi action in the regulator automatically during the breathing cycle. Thus, for example U.S. Pat. No. 4,214,580 to Pedersen discloses a breathing apparatus of the venturi action regulator-type hereinabove discussed which utilizes an additional moving baffle to alter the venturi effect after the diver initially inhales. While such modification to the venturi action is accomplished automatically, it does not appear to be responsive to ambient water pressure variation with depth.

Another prior art patent which addresses manual control aspect of venturi-type demand regulators is disclosed in U.S. Pat. No. 4,147,176 to Christianson. This patent discloses the concept of using a conical platform in conjunction with a diaphragm wherein the diaphragm gradually flattens down against the platform to reduce the effect of sensing area during the breathing cycle. One embodiment is disclosed which has an adjustable aspirator which permits the diver to externally change the aspiration effect during the dive. Unfortunately, there is an inherent disadvantage in the manner in which the diaphragm and conical platform interact to control the venturi assist during the breathing cycle which makes the performance of the regulator substantially non-uniform during the breathing cycle. As a result, the diver may adjust the regulator characteristics to provide him with an advantageous operation for one aspect of the breathing cycle only to find that during another portion of the breathing cycle the adjustment is unsuitable.

U.S. Pat. No. 3,526,241 to Veit is directed to an oxygen-air diluter for breathing apparatus employing an altitude controlled Venturi mixing mechanism. Referring to FIG. 1, the diluter apparatus is shown in its low altitude configuration with conically shaped valve member 24 sealing conical valve seat 18. Referring to FIG. 2, the diluter is shown in a high altitude configuration. Here, bellows 47 has expanded due to the lower air pressure exposed through aperture 49. Through the interaction of the associated elements, conically shaped valve member 24 is drawn away from conical valve seat 18, thereby permitting oxygen to enter Venturi throat portion 22 from inlet 12.

U.S. Pat. No. 4,796,618 to Garrafffa is directed to a breathing regulator apparatus having a manually adjusted Venturi valve. Referring to FIG. 2, flow vane 22 is adjusted so that all or virtually all of the air stream 28 emanating from the air inlet valve 18 is directed into the mouthpiece tube 19. Referring to FIG. 3, the position of flow vane 22 has the effect of splitting the air stream 28 into two components, namely, a first component 30 which is directed towards the diaphragm 16 and a second component 32 which is directed through the mouthpiece tube 19.

U.S. Pat. No. 3,308,817 to Seeler is directed to a reduction regulator valve for a scuba system having an automatic depth controlled mixing adjustment system. Referring to the Drawings, when a diver descends into deeper water, the pressure exerted by the water within the end cap 25 on the bellows 49 will contract the bellows, which in turn will permit the coil spring 57 to extend, thereby lessening the pressure on the diaphragm 54, permitting the valve 36 to close under the action of the valve spring 37. The reduction of the pressure exerted on the diaphragm 54 and the closing of the valve 36 reduces the pressure exerted on the housing side of the diaphragm 63, permitting the spring 61 to press against the diaphragm 63 and urge the rod 64 against the valve 41, opening the passageway 65 to the tank containing a mixture of helium and oxygen to admit same to the outlet port 23 into the mouthpiece 73. Note, however, that this reference does not employ a Venturi action.

U.S. Pat. No. 5,368,020 to Beux is directed to a depth controlled automatic mixing system for breathing apparatus. FIG. 7 shows a type B reducer which increases the flow of gas with increasing environmental pressure. This reducer comprises a body 200, a diaphragm 201 cooperating with a disk 202 which, by means of a mechanical connection member 203, cooperates with a further disk 204 associated with a diaphragm 205 which, by means of the disk 206 and the mechanical connection element 207, cooperates with a plug 208. Stress is placed on the diaphragm 201 by environmental pressure, that is to say, by water pressure, which acts directly on the surface of the diaphragm 201 through the bore 209, providing the calibration thrust which varies according to environmental pressure. Through the flow restriction nozzle 212, the gas enters the tube 213 which sends it to the inspiration bag.

Many scuba manufacturers solve the surface free flow problem by positioning a blade or vane near the air exit point of the second stage. The result is that air that travels out of the valve mechanism (located inside second stage) is blocked or re-routed back inside the second stage case before its velocity can create a venturi or free flow condition of the second stage.

These blades or vanes can also be manually re-positioned to allow rapid unobstructed air passage through the second stage causing the second stage to venturi assist (free flow). This venturi assist will increase the regulator performance by lowering the mechanical effort (or diver inhalation effort) required to breath the second stage.

A disadvantage of the manual design is that the scuba regulator second stage is located in the mouth and held by the teeth by means of a rubber mouthpiece. Locating the manual switch is difficult and confusing. This adjustment is made by feel not sight when the regulator is in the mouth. These manual switches tend to be small and located in difficult locations to reach with the fingers. Also, divers that wear a thermally protecting glove cannot locate these manual switches. Sometimes the adjustment is so difficult to locate, the entire second stage must be removed from the mouth so the diver can see where the exact tuning position is with respect to incremental notching or indicator numbers. This is deemed an unsafe procedure. A better non-manual flow control is needed.

There is, therefore, a need to provide a regulator which is of the breathing demand-type, which utilizes venturi assist to control the degree of air inlet opening, which provides the user with an automatic adjustment for varying the venturi effect during the dive and which, most importantly, provides either a constant or a smooth changing level of performance during the entire breathing cycle by adjustment for depth of the diver during the dive.

SUMMARY OF THE INVENTION

The present invention comprises an inhalation demand breathing regulator which solves the aforementioned need. More specifically, the present invention comprises a breathing regulator in which an automatically adjustable flow deflector or flow vane is utilized to create a diversion of high velocity air to direct it at the mouthpiece area of the regulator housing whereby to provide an automatic means for increasing the vacuum assist in demand regulators. When the flow vane is withdrawn, the air strewn is redirected back into the housing, thus balancing the low pressure area behind the diaphragm which prevents a free flow condition and allows the demand regulator to be less sensitive to ambient water conditions. The automatic flow control, or A.F.C., is used in scuba diving regulator second stages to automatically regulate the venturi or aspirated flow of air to the diver at different depths. A.F.C. allows the regulator second stage to be stable on the surface (no venturi) and yet provides excellent performance at depth (maximum venturi) automatically freeing the diver of making any needed manual adjustments to the second stage under water. Unlike the prior art, the present invention does not depend upon the relative position of a diaphragm and for example, a conical platform which relationship varies non-linearly during a breathing cycle. The effect of the present invention is a venturi assisted demand regulator which is less complex in structure, more reliable and more predictable in performance and which varies automatically with depth increasing the venturi effect or assist level as the diver descends and reducing the venturi effect or assist level as the diver ascends.

OBJECTS OF THE INVENTION

It is therefore a principal object of the present invention to provide an improved venturi assisted demand-type breathing regulator primarily for use in diving and which entirely overcomes or at least substantially reduces the deficiencies of the prior art.

It is an additional object of the present invention to provide a venturi assisted demand-type breathing regulator primarily for use by scuba divers wherein the extent to which the venturi action affects the air flow is automatically varied during the dive in accordance with the depth of the diver.

It is still an additional object of the present invention to provide a venturi assisted demand breathing regulator utilizing deflector vane which, depending upon the position of the vane determined by ambient water pressure, increasingly deflects a portion of the air stream toward the mouthpiece thus increasing the venturi effect thereby allowing the demand regulator to be responsive to ambient water conditions.

It is still an additional object of the present invention to provide an automatically adjustable venturi assisted demand breathing regulator particularly advantageous for scuba diving wherein depth of the diver automatically adjusts a device for interfering with the air stream emanating from the inlet valve into the housing whereby the degree to which the venturi effect aids the diver's breathing may be automatically varied so that the breathing effort is compensated in accordance with the diver's depth.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which.

DESCRIPTION OF A PREFERRED EMBODIMENT

Figure 1:
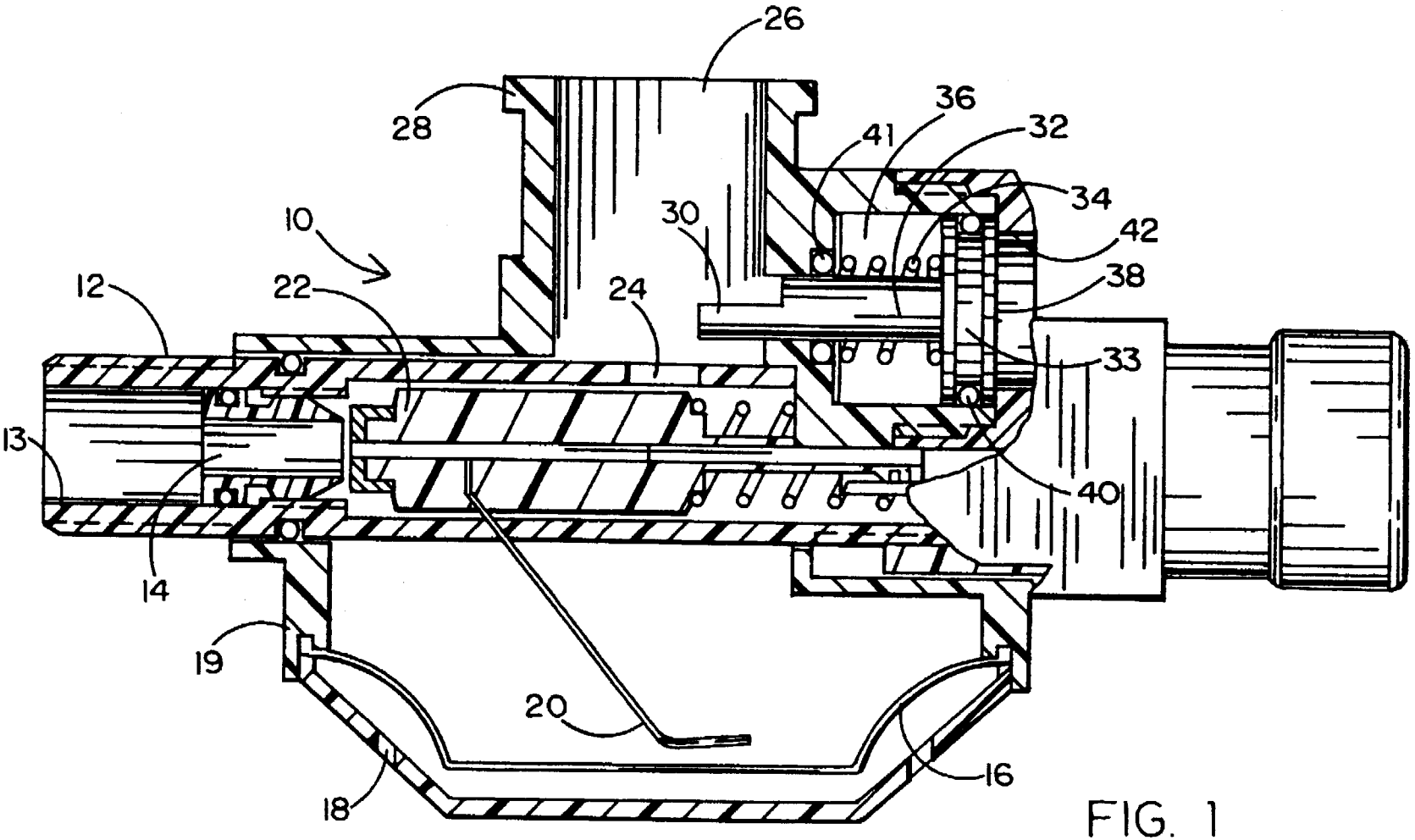
FIG. 1 is a top cross-sectional view of the breathing regulator of the present invention configured for operation at the surface.

Referring first to FIG. 1 it will be seen that the improved breathing regulator apparatus 10 of the present invention comprises a demand valve 12 having an air inlet tube 13 which will be connected to a suitable source of pressurized air supply in a well-known manner. Apparatus 10 also comprises a diaphragm 16 cooperating with a lever 20 to selectively actuate the air inlet demand valve 12 in response to the breather's inhalation requirements. Lever 20 unseats a popper 22 from an orifice 14 to open valve 12. Apparatus 10 also provides a mouthpiece tube 28 connected to a mouthpiece (not shown) which is normally retained within the mouth of the user permitting access to incoming air from air passage 26. Apparatus 10 also provides a piston-controlled deflector or flow vane 30 which comprises the critical component of the present invention as is hereinafter discussed. Apparatus 10 also comprises exhaust ports and an exhaust valve (not shown) which in combination, provide means for exhausting the exhalation gas of the user through the regulator 10.

The position of diaphragm 16 is determined by the relative pressure differential on opposing sides of the diaphragm within the diaphragm cover 18 and housing 19. The center of the diaphragm is provided with a bearing surface which bears against the lever 20 the position of which determines whether the air inlet valve 12 is opened or closed.

When the user begins to inhale through the mouthpiece tube 28, the air pressure in the interior of the regulator is reduced. This reduction in the air pressure causes the central portion of diaphragm 16 to be sucked in towards the mouthpiece tube and compresses lever 20 and opens the air inlet valve 12. When the air inlet valve is opened, a stream of air is generated and flows through air exit 24 in the general direction of the mouthpiece tube 28 through the mouthpiece tube passage 26 thereby responding to the user's inhalation requirements, but also creating a venturi effect generated by the high velocity air emanating from the air inlet valve 12. This high velocity air pulls the still air inside the regulator along with it, causing a secondary pressure drop or a vacuum to exist inside the interior of the regulator.

The initial inhalation effort required to open the air inlet valve 12 is commonly referred to as the cracking effort. The extent of inhalation effort required after the cracking effort level has been reached depends on the extent to which the level of venturi assist is utilized during the remainder of the breathing cycle. In those prior art regulator devices in which virtually no further breathing effort is required, the user may incur a disadvantageous condition in which the air inlet valve remains open due to the venturi effect thus creating a condition of free flow which in effect forces air into the user's lungs. Such a condition may be desirable for the experienced diver under certain deep dive or other difficult breathing conditions. However, the less experienced diver may find such a free flow condition to be frightening or otherwise disadvantageous. For example, such free flow conditions occurring when the regulator is out of the mouth of the user can create a panicky environment for the diver who feels great concern over the loss of air from his tanks.

Figure 2:
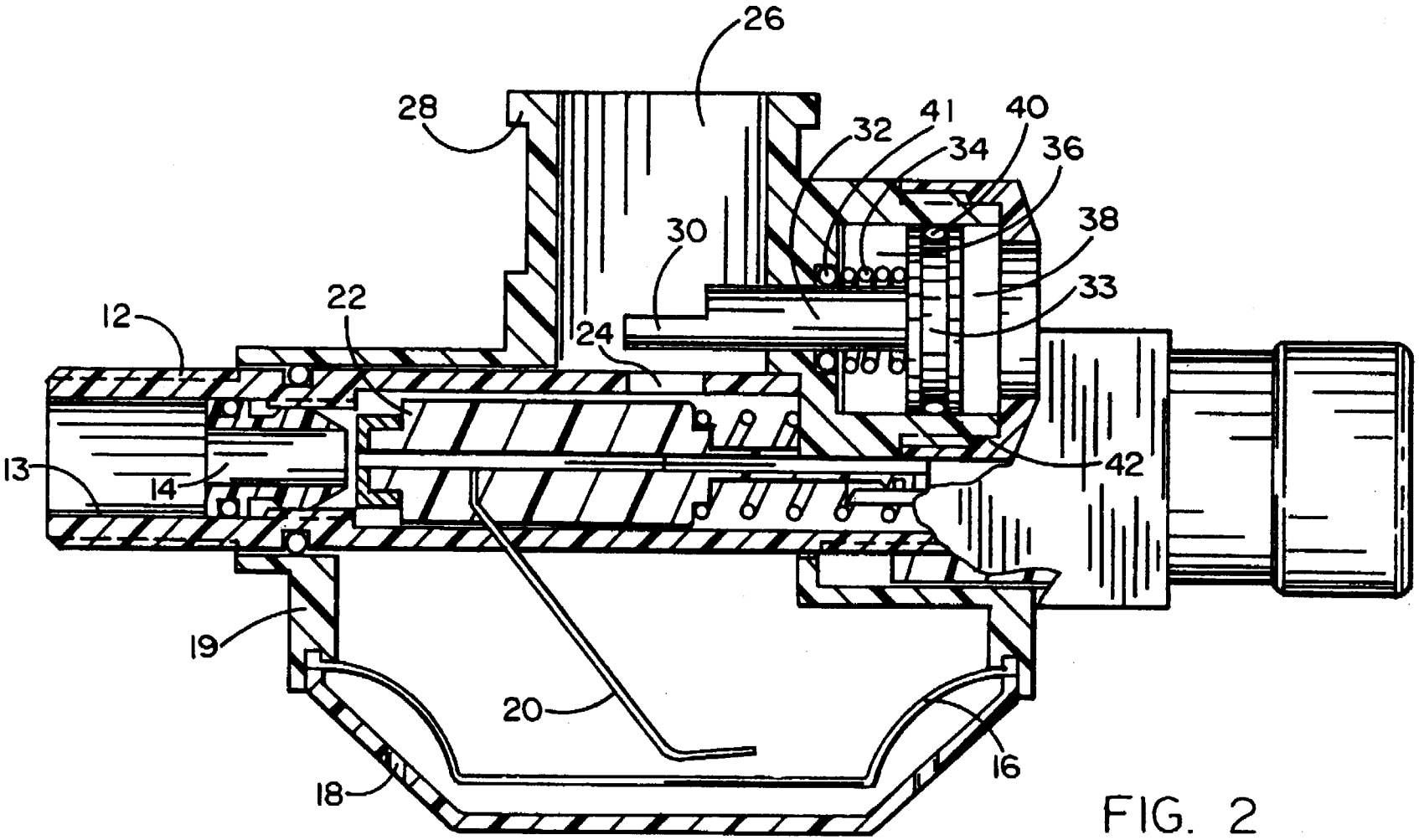
FIG. 2 is a similar top cross-sectional view of the invention illustrating the manner in which the invention automatically adjusts venturi effect for depth.

In any case, as previously noted, the relevant prior art has already disclosed means for manually changing the venturi assist effect whereby to overcome the noted disadvantages of those regulators which have employed full venturi assist configurations. The present invention however provides a novel means for automatically varying the venturi assist as a function of depth. More specifically, FIGS. 1 and 2 illustrate two different automatic adjustment configurations of the flow deflector tip or vane 30 of the present invention.

Figure 3:
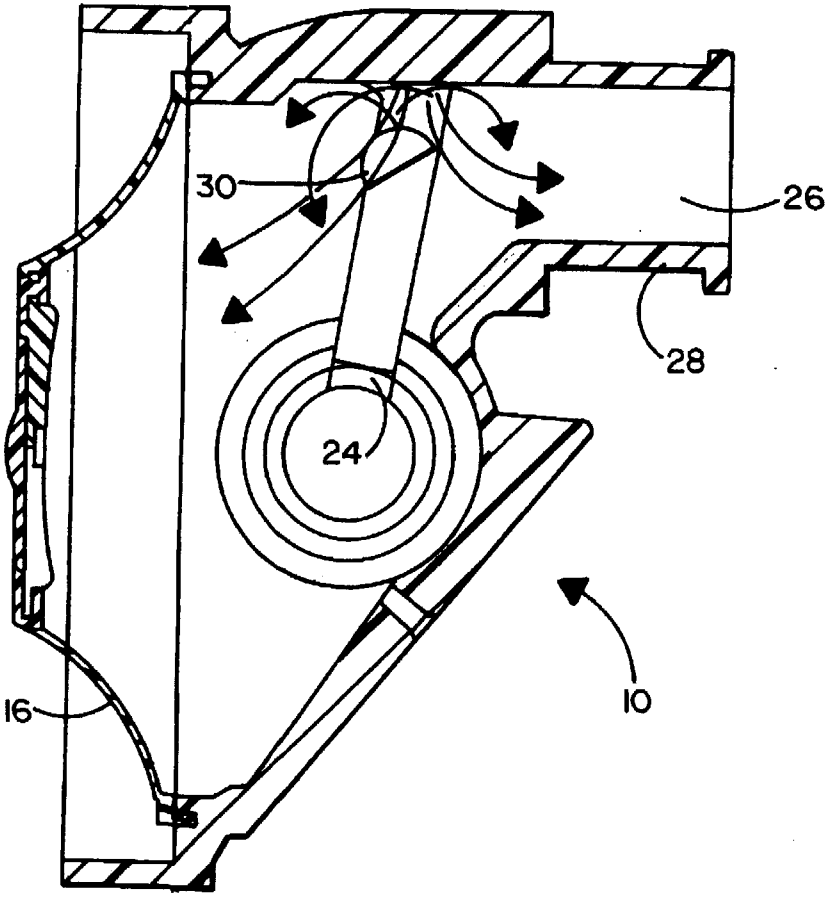
FIG. 3 is a side cross-sectional view of the breathing regulator illustrating air flow with automatic adjustment for surface operation.

Automatic Flow Contorl at Surface Operation (SEE FIGS. 1 and 3)

Air from the first stage is passed through an air pressure hose to the orifice 14. As the diver demands air, the inhalation diaphragm 16 bows inward and forces the demand lever 20 down moving the popper 22 away from the orifice 14. Air travels past the popper and exits from the air exit 24 and into the mouthpiece tube 28. Due to the position of the air exit, the exiting air cannot build up enough velocity to sustain a free flow venturi effect. The position of the deflector tip 30 is retracted in its surface resting position. A piston comprising piston head 33 and piston rod 32 remains static by a low ambient pressure in a pressure cavity 38 which merely balances the pressure in a sealed pressure chamber 36. Spring 34 assures retraction of the flow vane and the surface performance is stable due to no venturi, free flow.

As shown in FIG. 3, when the deflector tip 30 is in the retracted position at or near the surface or zero depth, the air stream bypasses the deflector tip. A significant portion of the air flow from air exit 24 is redirected toward the diaphragm after deflecting off of the top portion of the mouthpiece tube 28.

Figure 4:
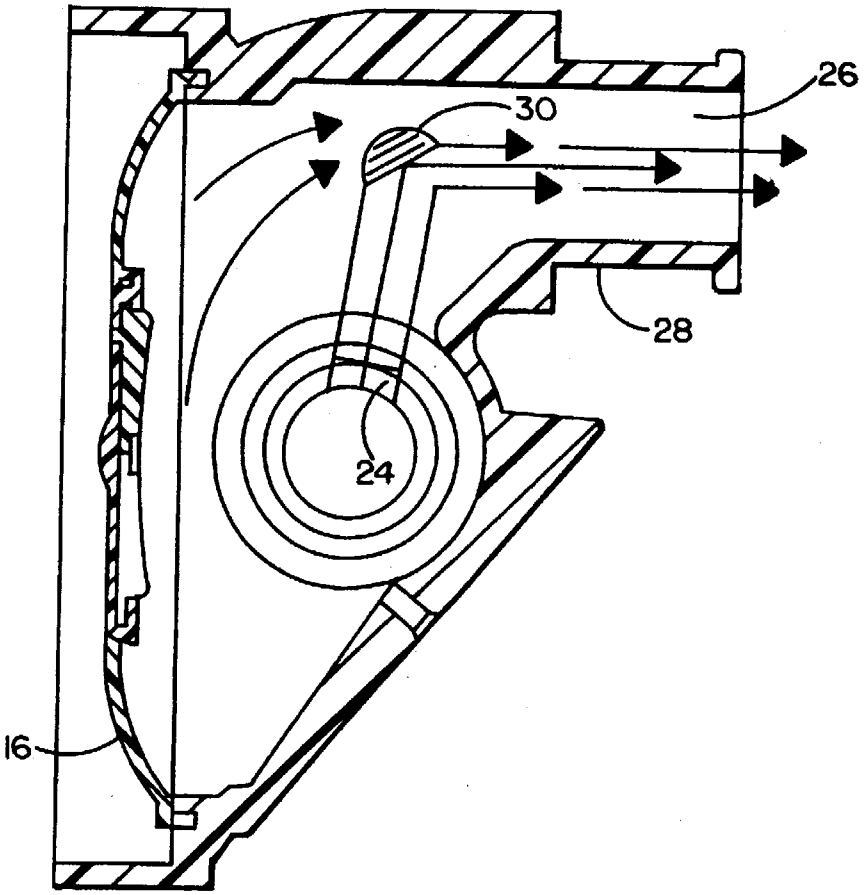
FIG. 4 is a similar side cross-sectional view of the breathing regulator illustrating air flow with automatic adjustment for operation at or near maximum depth.

Automatic Flow Control at Depth Operation (SEE FIGS. 2 and 4)

As the diver descends under water, ambient water pressure increases in the ambient water pressure cavity 38 and presses the piston head 33 and rod 32 forward, compressing the return spring 34 and increasing the pressure in the sealed pressure chamber 36. The deflector tip 30 now straightens the air leaving the air exit 24 thus creating a venturi effect and increasing regulator performance. As shown in FIG. 4, at significant depths, the deflector tip 30 enters the air stream deflecting a major portion toward the mouthpiece tube 28 and through the passage 26. This deflected flow creates a vacuum assist to bow the diaphragm 16 inwardly and lower the effort required to sustain flow. As the diver ascends back to the surface, the pressure is relieved from the ambient water pressure cavity 38 and the deflector tip 30 returns to its surface resting position and the second stage becomes stable once again. The O-rings 40 and 41 assure pressure integrity of chamber 36 and cavity 38 and retaining cap 42 secures return spring 34 and the piston.

Thus it will be understood that the present invention provides a novel second stage scuba diving breathing regulator having automatic flow control wherein a venturi assist effect is automatically adjusted with depth to provide no venturi effect at the surface and an increasing venturi effect as the diver descends.

Those having skill in the art to which the present invention pertains, will now, as a result of the disclosure herein, perceive various modifications which may be made to the invention. By way of example, the precise location and structure of the flow control mechanism may be altered while still achieving the novel objective of automatic flow control with depth of the diver as the variable parameter. Furthermore, the deflector tip of the invention may be configured to travel in either direction with increasing depth and thus alter air flow either proportional to depth or inversely proportional to depth. The latter configuration can be used to increase vacuum assist with increasing depth by altering the direction of the nominal air flow to provide more deflection away from the mouthpiece tube with increasing extension of the deflector tip at shallower depths. This would constitute a reversal of the disclosed embodiment while achieving the same result. Accordingly, all such modifications are deemed to be within the scope of the invention which is to be limited only by the appended claims and their equivalents.

I claim:

1. An improved second stage breathing regulator for divers, the regulator having a demand valve to be connected to a source of pressurized air and a pressure-activated device for opening the demand valve to direct air into the regulator and to a mouthpiece tube to be held in the mouth by a diver, the regulator of the type wherein changes in the direction of air flow out of an air exit within the regulator produces a variation in venturi effect from small to large to progressively reduce the breathing effort required to keep open the demand valve; the improvement comprising:

a deflector member located within said regulator for movement relative to said air exit for redirecting said air flow relative to said mouthpiece tube for changing said venturi effect; and means for controlling the movement of said deflector member in response to the ambient water pressure surrounding said regulator.

2. The improvement recited in claim 1 wherein said movement controlling means comprises a piston having a piston head and a piston rod, the piston head separating two respectively isolated chambers including a first chamber having ambient water pressure therein and a second chamber having surface water pressure therein; the relative difference in the pressures in said first and second chambers determining the position of said piston.

3. The improvement recited in claim 2 wherein said deflector member comprises a distal end of said piston rod.

4. The improvement recited in claim 2 wherein said movement controlling means further comprises a compression spring located for resisting the movement of said piston rod toward said air exit.

5. The improvement recited in claim 2 further comprising an O-ring positioned annularly around said piston head for isolating the first and second chambers from one another.

6. The improvement recited in claim 1 wherein said movement controlling means comprises a piston having a rod portion and a head portion; the head portion providing a movable sealing surface between a first chamber at ambient water pressure and a second chamber at a selected constant water pressure, said rod portion having a distal end terminating in said deflector member, whereby increasing ambient water pressure forces said piston to move said deflector member toward said air exit.

7. The improvement recited in claim 1, said regulator having a first chamber open to ambient water pressure and a second chamber having an initially selected pressure therein, said means comprising a piston having a sealing head separating said first and second chambers and said piston also having a rod terminating in said deflector member; said piston being forced to move in accordance with the pressure difference between said first and second chambers.

8. The improvement recited in claim 7 further comprises a spring positioned relative to said piston rod to add resistance to movement of said deflector member toward said air exit whereby tending to return said deflector member to a stable position of minimum venturi effect.

9. The improvement recited in claim 7 further comprising at least one O-ring for isolating said first chamber from said second chamber.

10. The improvement recited in claim 7 further comprising at least one O-ring for isolating said second chamber from said deflector member.

* * * * *